US009163914B2

(12) United States Patent
Carton

(10) Patent No.: US 9,163,914 B2
(45) Date of Patent: Oct. 20, 2015

(54) EXPLOSIVE CUTTING

(75) Inventor: Erik Peter Carton, Delft (NL)

(73) Assignee: NEDERLANDSE ORGANISATIE VOOR TOEGEPAST-NATUURWETENSCHAPPELUK ONDERZOEK TNO, Delft (NL)

( * ) Notice: Subject to any disclaimer, the term of this patent is extended or adjusted under 35 U.S.C. 154(b) by 0 days.

(21) Appl. No.: 13/825,490

(22) PCT Filed: Sep. 22, 2011

(86) PCT No.: PCT/NL2011/050642
§ 371 (c)(1), (2), (4) Date: May 22, 2013

(87) PCT Pub. No.: WO2012/039617
PCT Pub. Date: Mar. 29, 2012

(65) Prior Publication Data

US 2013/0233194 A1 Sep. 12, 2013

(30) Foreign Application Priority Data

Sep. 22, 2010 (EP) ..... 10178298

(51) Int. Cl.
*F42B 3/22* (2006.01)
*F42B 5/10* (2006.01)
(Continued)

(52) U.S. Cl.
CPC ... *F42B 3/22* (2013.01); *B26F 1/26* (2013.01); *B26F 3/004* (2013.01); *B26F 3/04* (2013.01); *F42B 1/024* (2013.01); *F42B 3/08* (2013.01); *F42B 5/10* (2013.01); *F42B 15/00* (2013.01)

(58) Field of Classification Search
CPC ..... F42B 1/00; F42B 1/02; F42B 1/124; F42B 3/00; F42B 3/08; F42B 3/22; F42B 5/10; F42B 5/105; F42B 15/00; F42B 30/00; F42B 30/02; F42B 1/024; B26F 1/26; B26F 3/04; B26F 3/004; B23D 15/145
USPC ..... 102/305, 475
See application file for complete search history.

(56) References Cited

U.S. PATENT DOCUMENTS 1,191,357 A * 7/1916 Snyder ..... 102/380
2,307,369 A * 1/1943 Ferrel ..... 102/380
(Continued)

FOREIGN PATENT DOCUMENTS

EP 0 043 215 A1 1/1982
WO WO 86/07000 A1 12/1986
(Continued)

*Primary Examiner* — James S Bergin
(74) *Attorney, Agent, or Firm* — Lucas & Mercanti, LLP

(57) ABSTRACT

A method for explosive cutting using converging shock-waves, and an explosive cutting device are disclosed. The method includes providing a projectile with an explosive charge, positioning the projectile over the object so it extends along an intended line of cut, and detonating the explosive charge so that the projectile is accelerated toward the object, wherein the projectile either impacts on the object and the projectile includes a wave-shaping element which is shaped such that the impact generates converging shockwaves in the underlying object to be cut causing a crack to be propagated through the object along the intended line of cut; or impacts on a wave-shaping element in contact with the object, the wave-shaping element being shaped such that the impact generates converging shockwaves in the underlying object causing a crack to be propagated through the object along the intended line of cut.

15 Claims, 2 Drawing Sheets

(51) Int. Cl.

| | |
|---|---|
| ***B26F 3/04*** | (2006.01) |
| ***B26F 1/26*** | (2006.01) |
| ***F42B 3/08*** | (2006.01) |
| ***F42B 15/00*** | (2006.01) |
| ***B26F 3/00*** | (2006.01) |
| ***F42B 1/024*** | (2006.01) |

(56) References Cited

U.S. PATENT DOCUMENTS

| | | | | |
|---|---|---|---|---|
| 2,424,934 | A * | 7/1947 | Kasper | 102/380 |
| 3,076,408 | A | 2/1963 | Poulter et al. | |
| 3,435,763 | A * | 4/1969 | Lavine | 102/305 |
| 3,490,372 | A * | 1/1970 | Lavine | 102/309 |
| 3,517,615 | A | 6/1970 | Jacobs | |
| 3,815,503 | A * | 6/1974 | Infantino | 102/374 |
| 4,408,535 | A * | 10/1983 | Alford | 102/305 |
| 7,448,325 | B2 * | 11/2008 | Harrison | 102/524 |
| 8,037,828 | B1 * | 10/2011 | Jakaboski et al. | 102/305 |

FOREIGN PATENT DOCUMENTS

| | | |
|---|---|---|
| WO | WO 8802470 A2 | 4/1988 |
| WO | WO 89/09376 A1 | 10/1989 |

* cited by examiner

EXPLOSIVE CUTTING

CROSS-REFERENCE TO RELATED APPLICATIONS

This application is a 371 of PCT/NL2011/050642, filed Sep. 22, 2011, which claims the benefit of European Patent Application No 10178298.5, filed Sep. 22, 2010, the contents of each of which are incorporated herein by reference.

FIELD OF THE INVENTION

The invention is directed to a method for explosive cutting, more in particular to a method of explosive cutting using converging shockwaves, and to an explosive cutting device.

BACKGROUND OF THE INVENTION

Explosives are convenient sources of energy which can be suddenly released in order to perform work on various targets. Accordingly explosives have been applied for the breaking or cutting of solid materials, such as metal. This may serve purposes of demolition, separation of components of an integral structure or destruction of or damage to a target. In particular at sites which are difficult to access, or which are considered dangerous, the application of explosives may provide an outcome. Several methods of explosive cutting are known in the art.

A known method of explosive cutting is by means of shaped charges such as linear cutting charges. A linear cutting charge generally comprises a length of metal which is, e.g. substantially semi-circular of V-shaped in cross-section and an explosive which extends the length of the metal and which must be capable of sustaining detonation with a high velocity of propagation. The length of metal is arranged with its hollow side directed towards and spaced from the target metal to be cut, whilst the explosive extends centrally of and in contact with the opposite side of the length of metal. With a semicircular section length of metal the explosive, when detonated, acts on the length of metal to evert the length of metal and project a part of it as a high velocity metal jet at the target, the target thus being severed if the charge is sufficiently powerful. In the case of a V-section length of metal, the pressure exerted by the explosive, when detonated, serves to drive the two limbs of the V-section length of metal towards one another at high velocity so that they collide. As a result of the collision of the said two limbs a small part of each of the limbs is stripped off and is projected at the target as an extremely fast-moving blade-like jet which is capable of producing a very deep and narrow cut in a metal target for a given amount of explosive. Explosive cutting using shaped charges has disadvantages in that the application of a metal jet has low energy efficiency (a relatively high amount of explosive is required per cutting length), and that the jet may cause side damages if the jet shoots through the object to be cut after penetration.

A further known method of explosive cutting applies a shockwave refraction tape (SRT) in contact with the material to be cut [WO-A-86/07000]. The SRT consists of a wave-shaping element covered by a layer of explosive. The wave-shaping element generally looks like an isosceles triangle with a large base containing a nick. When the explosive is detonated, a pair of converging shockwaves at an angle to each other set off into the target object to be cut. The converging shockwaves collide in the material to be cut, which creates an enormous pressure. This pressure wave in the target is followed by a huge tensile stress wave when the two release waves (that follow the shock waves) interact. This creates a fracture in the material plane in which the shock and release waves interact [*New Scientist* 1986, 110(1504), 28]. In order to generate sufficiently powerful shockwaves, this method requires the use of so-called high explosives that have a detonation velocity of above 7 km/s. Transportation and storage of such high explosives is, however, bounded to severe safety rules and therefore impractical and very costly. In addition, the use of highly explosive materials is normally accompanied with the application of government permits.

It would be desirable to provide an alternative method of explosive cutting which allows at least partly overcoming drawbacks faced in the prior art.

SUMMARY OF THE INVENTION

Object of the invention is to provide an alternative method of explosive cutting using converging shockwaves.

Further object of the invention is to provide a method of explosive cutting which method uses readily transportable (preferably even by air transport) and storageable explosive material than applied in the prior art.

The inventors surprisingly found that one or more of these objects can be met by application of a cutting means which is accelerated by an explosive and generates converging shockwaves material to be cut.

Accordingly, in a first aspect the invention is directed to a method of explosive cutting, comprising:

- providing a projectile with an explosive charge for accelerating said projectile in the direction of an object to be cut;
- positioning said projectile over the object to be cut such that it extends along an intended line of cut, whereby the projectile is spaced from the object to be cut;
- detonating the explosive charge so that the projectile is accelerated in the direction of the object to be cut, wherein
  - i) the projectile impacts on the object to be cut and the projectile comprises a wave-shaping element which is shaped such that the impact generates converging shockwaves in the underlying object to be cut causing a crack to be propagated through the object substantially along the intended line of cut; or
  - ii) the projectile impacts on a wave-shaping element in contact with the object to be cut, the wave-shaping element being shaped such that the impact generates converging shockwaves in the underlying object to be cut causing a crack to be propagated through the object substantially along the intended line of cut.

DETAILED DESCRIPTION OF THE INVENTION

Figure 1A:
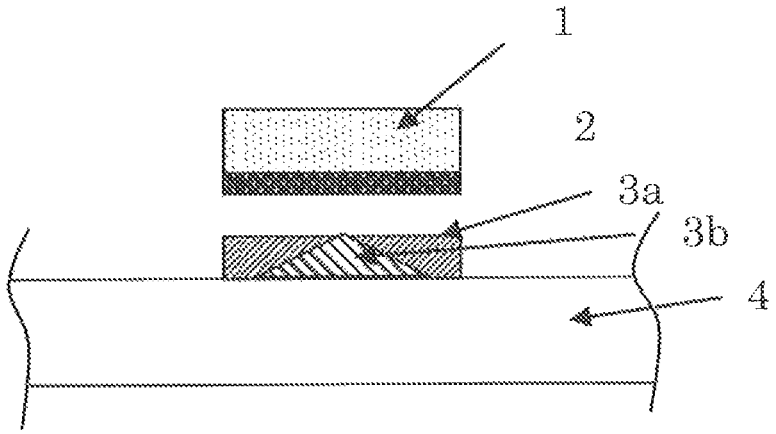
FIG. 1A is a schematic cutting configuration in accordance with the invention.

In accordance with the invention, the projectile is positioned over the object to be cut and subsequently accelerated in the direction of the object to be cut by detonation of the explosive charge. Impact of either the projectile comprising a wave-shaping element on the object to be cut or of the projectile on a wave-shaping element in contact with the object with to be cut, causes a crack to be propagated through the object substantially along the intended line of cut.

Accelerating the projectile can be achieved using a conventional explosive charge. Suitable examples of explosives include RDX (cyclotrimethylene-trinitramine), HNS (hexanitrostilbene), HMX (cyclotetramethylene-tetranitramine), PETN (pentaerythritel tetranitrate) and plastic-bonded versions (PBX) thereof.

Advantageously, it is also possible to accelerate the projectile by using a binary explosive charge, comprising two components, each of which is non-explosive in isolation. A binary explosive charge only becomes explosive when the two components thereof are combined and well mixed.

The use of binary explosives in accordance with the invention is highly advantageous from a transport perspective, because each separate component is non-explosive. Binary explosives are normally considered to have insufficient explosive strength in order to be effectively used in conventional explosive cutting using a linear cutting charge or shockwave refraction tape. However, these binary explosives have sufficient explosive strength for accelerating the projectile for the impact purpose of the invention. It is surprising that these heterogeneous explosives can be used in a method for explosive cutting.

Binary explosive materials are well-known in the art and commercially available. Some examples of binary explosives include a combination of ammonium nitrate and fuel oil, a combination of liquid oxygen and combustible powder, a combination of ammonium nitrate and nitromethane, a combination of ammonium nitrate and aluminium, and a combination of nitroethane/physical sensitizer. One of the most common binary explosives is made by adding about 5 wt. % fuel oil to about 95 wt. % ammonium nitrate. This binary explosive is commonly referred to as "ANFO".

Typically, a binary explosive charge generates a detonation velocity in the range of 1-4 km/s. Detonation velocities can be determined using an electronic decade counter in combination with ionisation pins in the explosive, or the Dautriche method (J. Köhler, R. Meyer, and A. Homburg, *Explosives,* Sixth Completely Revised Edition, Wiley-VHC Verlag GmbH, Weinheim, 2007, page 72).

Normally, the projectile to be used in accordance with the invention will comprise one or more metals. Preferably, the projectile consists of metal. Suitable metals and alloys of metals include lead (Pb), copper (Cu), iron/steel (Fe) and aluminium (Al).

The projectile to be used in accordance with the invention is preferably in the form of a strip or plate which extends along the length of the intended line of cut. Advantageously, the cross-section of the projectile is defined by two legs and a cavity in between, so that impact of the projectile on the object to be cut with the two legs generates converging shockwaves on either side of the intended line of cut. The projectile can, for instance, be substantially V-shaped in cross-section (∧), substantially semi-circular in cross-section (⌒), or substantially U-shaped in cross-section (∩). The projectile can further be substantially H-shaped in cross-section (|—|). Such shapes are capable of generating converging shockwaves.

It is also possible, in accordance with the invention to use a projectile in combination with a wave-shaping element in contact with the object to be cut. Impact of the projectile on the wave-shaping element then results in converging shockwaves for cutting the object. In such a case, the shape of the projectile is less critical. For example, the projectile can have a substantial plate-like shape. However, other projectile shapes are possible as well.

The projectile may be accelerated from a holding element, which initially holds the projectile spatially from the object to be cut. If present, the holding element retains the projectile such that upon detonation the projectile can freely accelerate in the direction of the object to be cut. The term "freely accelerate" in this context is meant to refer to an acceleration which is not hindered such that the projectile changes direction, or that the velocity of the projectile is decreased to an extent that prevents the projectile to generate the required converging shockwaves.

In an embodiment, the projectile comprises the explosive at the side opposite of the object to be cut. Upon detonation of the explosive, the projectile is then accelerated in the direction of the object to be cut. Alternatively, or in addition, explosive material may be provided on the holding element.

For detonation, the projectile or the holding element can be provided with one or more detonation means that are connected to the explosive charge. The explosive charge can suitably be provided over the entire length of the projectile.

It is preferred that the projectile is accelerated at an angle substantially perpendicular to the surface of the object to be cut. More preferably, the projectile is accelerated along the surface normal of the object to be cut.

Initially, the projectile is spaced from the object to be cut, preferably at a distance in the range of 0.2-5 cm, more preferably at a distance of 0.3-2 cm, such as at a distance in the range of 0.5-1.5 cm.

The wave-shaping element may be a conventional shockwave refraction tape (SRT), such as described in WO-A-86/07000. Such SRTs are commercially available. However, it is preferred that only a wave-shaping element is used without an explosive charge on the wave-shaping element, because in accordance with the invention the energy required for generating the converging shockwaves is provided by the impact of the projectile. Nonetheless, in some embodiments the projectile may impact on an explosive charge provided on the wave-shaping element so that additional energy is provided for.

The wave-shaping element serves the purpose of generating convergent shockwaves in the object to be cut. Various geometries have been reported for providing suitable shockwaves in an object to be cut. Reference can, for instance, be made to WO-A-86/07000, WO-A-89/09376, and EP-A-0 043 215. These geometries may be employed for the wave-shaping element as well as for the projectile. A wave-shaping element typically comprises a first material having a higher shockwave propagation velocity than a second material also comprised in said wave-shaping element. The shape and difference in shockwave propagation velocity between the two different materials of the wave-shaping element can create two converging shockwaves in the material to be cut.

In an embodiment, the projectile itself comprises a wave-shaping element. The projectile can then comprise a first material having a higher shockwave propagation velocity than a second material also comprised in the projectile. Upon impact of the projectile on the material to be cut, the shape and difference in shockwave propagation velocity between the two materials can then create two converging shockwaves. In such an embodiment, no additional wave-shaping element in contact with the material to be cut is required. In an embodiment, the projectile itself is a wave-shaping element.

Objects to be cut can for instance be metal or concrete objects, such as metal ship hulls, concrete blocks, offshore equipment including pipes and platforms.

The explosive cutting method of the invention can advantageously be used for explosive cutting in an environment which is difficult to access. Examples of such environments include a radioactive environment, underground (e.g. in a bore pipe), undersea (in combination with a tube or pipe that can stand the water pressure at depth), and in outer space. Such environments are dangerous for people and, hard to access for people and machinery.

A benefit of the explosive cutting method of the invention is that the cutting is immediate, and not a matter of several hours as in other conventional cutting methods. An explosive cutting configuration for the method of the invention is shown in FIG. 1A. In the embodiment shown in FIG. 1A, explosive charge (1) is in contact with projectile (2), which in turn has a stand-off from wave-shaping element (3) and object to be cut (4). Wave-shaping element (3) shown in FIG. 1A comprises a first material (3*a*) having a higher shockwave propagation velocity than a second material (3*b*). When wave-shaping element (3) is struck by projectile (2), the shape and difference in shockwave propagation velocity between the two Materials (3A) and (3B) will create two converging shod waves in material to be cut (4).

Figure 1B:
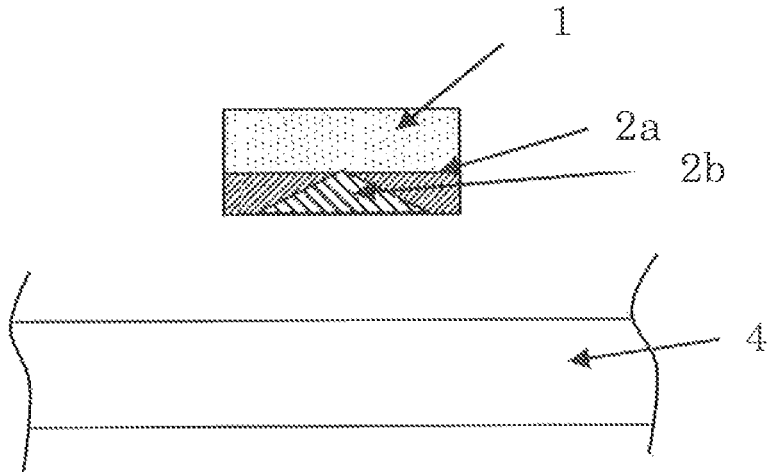
FIG. 1B is a schematic showing an explosive charge in contact with a projectile.

In accordance with a further embodiment, shown in FIG. 1B, explosive charge (1) is in contact with projectile (2), which itself is a wave-shaping element. Projectile (2) shown in FIG. 1B comprises a first material (2*a*) having a higher shockwave propagation velocity than a second material (2*b*). When projectile (2) impacts material to be cut (4), two converging shockwaves will be generated in material to be cut (4).

Figure 1C:
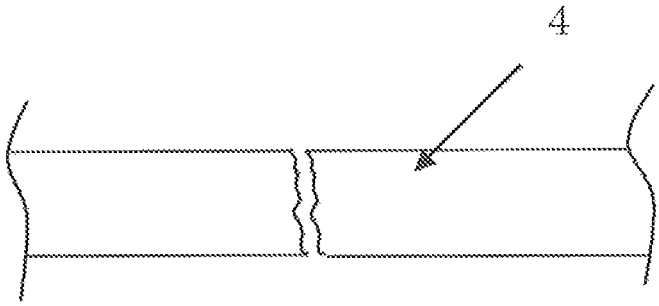
FIG. 1C shows material after cutting.

If the converging shockwaves are intense enough, the material will be cut or fractured along the line at which the two shock waves interact with each other. FIG. 1C shows the material after the cutting operation.

Figure 2:
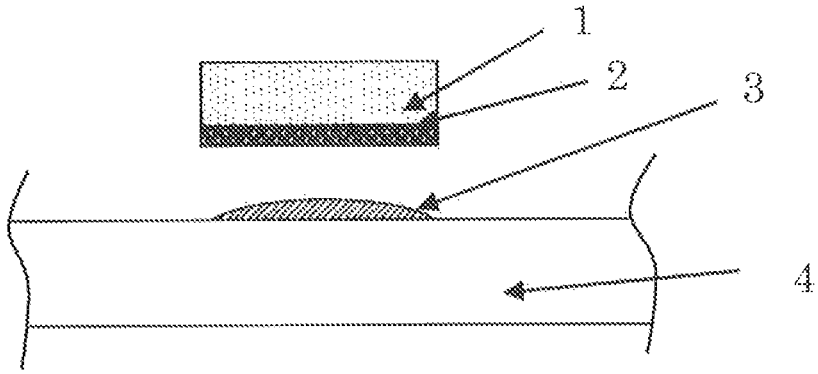
FIG. 2 is a schematic of second cutting configuration in accordance with the invention using a projectile strip and shockwave refraction tape.

In the embodiment of FIG. 2, explosive charge (1) is in contact with metal projectile strip (2) that is intended to impact on a strip of shockwave refraction tape (3) which is in direct contact with material to be cut (4). Due to the use of a projectile strip (2) intense shockwaves can be created upon impact with the shockwave refraction tape. Acceleration of projectile (2) may be achieved using either a high explosive or a binary explosive charge (1).

Figure 3:
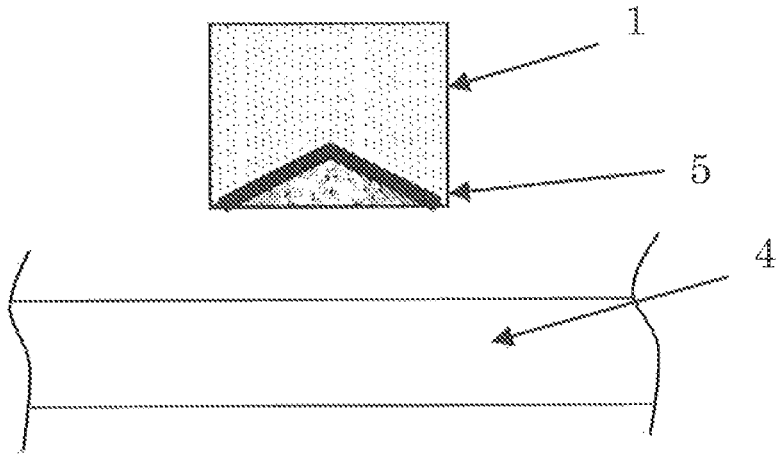
FIG. 3 is a schematic of a cutting configuration using a shaped metal strip.

FIG. 3 shows an embodiment of the invention using a specially shaped metal projectile strip (5) that is to impact material to be cut (4) directly. The edges of the strip will impact material to be cut (4) first, followed by material closer to the symmetry-line of the projectile (5). At high enough impact velocity this will create two converging shockwaves in material to be cut (4). In this case, the specially shaped metal projectile strip forms the wave-shaping element.

In a further aspect, the invention is directed to an explosive cutting device. The explosive cutting device can be used in the explosive cutting method of the invention. The explosive cutting device comprises a holding element, said holding element holding a projectile (2) which projectile (2) is provided with an explosive charge (1) connected to detonating means for detonating said explosive charge (1) and accelerating the projectile (2) in the direction of an object (4) to be cut, wherein i) the projectile (2) comprises a waveshaping element (2*a*, 2*b*) which is shaped such that the impact generates converging shockwaves in the underlying object (4) to be cut causing a crack to be propagated through the object (4) substantially along an intended line of cut; or ii) the projectile (2) is to impact on a wave-shaping element (3) in contact with the object (4) to be cut, the wave-shaping element (3) being shaped such that the impact generates converging shockwaves in the underlying object (4) to be cut causing a crack to be propagated through the object (4) substantially along a intended line of cut.

In case the projectile comprises the wave-shaping element, then the device also comprises the wave-shaping element. It will clear to the person skilled in the art that in the context of the present application the term "device" can also be considered an "apparatus" or a "system". These terms can be used interchangeably. Accordingly, the explosive cutting device can also be considered an explosive cutting system or an explosive cutting apparatus.

The invention claimed is:

1. Method of explosive cutting comprising:

providing a projectile with an explosive charge for accelerating said projectile in the direction of an object to be cut;

positioning said projectile over the object to be cut such that it extends along an intended line of cut, whereby the projectile is spaced from the object to be cut; and detonating the explosive charge so that the projectile is accelerated in the direction of the object to be cut, wherein the projectile impacts on a wave-shaping element in contact with the object to be cut, the wave-shaping element being shaped such that the impact generates converging shockwaves in the underlying object to be cut causing a crack to be propagated through the object substantially along the intended line of cut.

2. Method according to claim 1, wherein the explosive charge is a binary explosive charge, comprising two components, each of which is non-explosive in isolation.

3. Method according to claim 2, wherein said binary explosive charge comprises one or more selected from a combination of ammonium nitrate and fuel oil, a combination of liquid oxygen and combustible powder, a combination of ammonium nitrate and nitromethane, a combination of ammonium nitrate and aluminium, and a combination of nitroethane/physical sensitizer.

4. Method according to claim 1, wherein the projectile is substantially V-shaped in cross-section, substantially U-shaped in cross-section, substantially H-shaped in cross-section, or substantially semi-circular in cross-section.

5. Method according to claim 1, wherein the projectile has a substantial plate-like shape.

6. Method according to claim 1, wherein the projectile comprises a metal.

7. Method according to claim 6, wherein the projectile is metal.

8. Method according to claim 1, wherein the projectile, before detonation, is spatially held from the object to be cut by a holding element.

9. Method according to claim 1, wherein said wave-shaping element is substantially semi-circular or V-shaped in cross-section.

10. Method according to claim 1, wherein said wave-shaping element comprises a first material and a second material, wherein the first material has a shockwave propagation velocity which is higher than the shockwave propagation velocity of the second material.

11. Method according to claim 1, wherein said wave-shaping element comprises an explosive charge.

12. Method according to claim 1, wherein said explosive charge generates a detonation velocity in the range of 1-4 km/s.

13. Method according to claim 1, wherein the object to be cut comprises metal or concrete.

14. Method according to claim 1, for explosive cutting in a radioactive environment, for explosive cutting underground, for explosive cutting undersea, or for explosive cutting in outer space.

15. Method according to claim 1, wherein the object to be cut is selected from the group consisting of ship hulls, concrete blocks, and offshore equipment.

* * * * *